United States Patent [19]

Krauss-Kalweit

[11] 4,348,897

[45] Sep. 14, 1982

[54] METHOD AND DEVICE FOR DETERMINING THE TRANSMISSIBILITY OF A FLUID-CONDUCTING BOREHOLE LAYER

[76] Inventor: Irene Krauss-Kalweit, Schwarzwaldweg 5a, 6094 Bischofsheim, Fed. Rep. of Germany

[21] Appl. No.: 174,632

[22] Filed: Aug. 1, 1980

Related U.S. Application Data

[63] Continuation-in-part of Ser. No. 58,519, Jul. 18, 1979, abandoned.

[51] Int. Cl.[3] ..... E21B 47/10

[52] U.S. Cl. ..... 73/155

[58] Field of Search ..... 73/155, 151, 300, 301

[56] References Cited

U.S. PATENT DOCUMENTS

| | | | |
|---|---|---|---|
| 3,285,064 | 11/1966 | Greenkorn et al. | 73/155 |
| 3,559,476 | 2/1971 | Kuo et al. | 73/155 |
| 3,853,006 | 12/1974 | Lawford | 73/301 |
| 4,123,937 | 11/1978 | Alexander | 73/155 |
| 4,142,411 | 3/1979 | Deal | 73/155 |

*Primary Examiner*—Jerry W. Myracle

*Attorney, Agent, or Firm*—Webb, Burden, Robinson & Webb

[57] ABSTRACT

A method and apparatus for determining the transmissibility of a fluid-conducting layer (stratum), such as an aquifer that is accessible through a borehole. The fluid-level in the borehole is stimulated to a periodic or an aperiodic damped oscillation. By measuring and reading the motion of the fluid-level and evaluating the motion, the transmissibility can be calculated.

6 Claims, 2 Drawing Figures

METHOD AND DEVICE FOR DETERMINING THE TRANSMISSIBILITY OF A FLUID-CONDUCTING BOREHOLE LAYER

RELATED APPLICATION

This is a continuation-in-part of application Ser. No. 058,519, filed July 18, 1979, now abandoned.

BACKGROUND OF THE INVENTION

In the utilization, extraction, storing, and regulation of fluids such as water and petroleum, it is important to know the parameter that determines the quantitative output. The same applies to the lowering of ground water for purposes of draining, to the obtention of geothermic heat by means of water, and to related problems.

The quantitative output is proportional to the transmissibility of the fluid-conducting layer of earth.

The invention involves a method for the determination of the transmissibility in a fluid-conducting stratum especially an aquifer.

The transmissibility T is expressed by $$T=k\cdot d$$

which has the dimensions of $m^2/s$ (meters squared per second)

with k=permeability =length/viscosity=m/s and, d=thickness of the stratum (m).

The usual methods to determine the transmissibility of an aquifer are based on the evaluation of pumping tests. Less often injection tests are in use for this purpose.

For performing a pumping test, usually a pumping well and several observation pipes are drilled into the fluid-conducting layer. Then the fluid is pumped out for some time with a constant discharge. Thereby the water level in the pumping well and the observation pipes is lowered. From the lowering and/or resurgences in relation to space, time and the discharge, the transmissibility and the permeability are calculated.

Other possibilities for determining the transmissibility reside in introducing fluid into the formation that is to be examined. This may be done at a constant rate, with sudden changes, or periodically (U.S. Pat. No. 3,559,476). The flow or the change in pressure in the head of fluid is measured in the well itself or in adjacent boreholes (German Auslegeschrift 1,289,803).

Pumping tests are expensive and time consuming. Frequently they are difficult to carry out technically and present a problem in the disposal of the water that has been pumped out. Injection tests present similar problems. Here the technical execution, including the delivery of the fluid, the preparation of the wells, and the measurements themselves, are likewise expensive and time consuming.

It is the aim of the invention to avoid the high costs and technical difficulties of the pumping and injection tests and to measure directly from one borehole of small dimensions, the transmissibility of the surrounding stratum quickly and at lesser costs.

In addition to the different measuring principles, the chief differences between the present invention and the pressure measuring device of German Auslegeschrift 1,108,154 lie in the fact that the pressure measuring probe is equipped with a pressure compensating vessel disposed outside of the fluid in the air-filled portion of the well. This produces a compensation of the atmospheric pressure or the applied compressed air so that the movement of the surface of the water is measured.

SUMMARY OF THE INVENTION

This invention comprises a method including a first step of stimulating the fluid-level in the borehole to a periodic or an aperiodic damped oscillation, a second step of measuring and recording the motion of the fluid-level with a suitable receiver in the same borehole (for example, a pressure transducer), by digital or analog recording (for example, a compensation recorder) and a third step of evaluating the record to provide a transmissibility value.

An especially practicable and advantageous execution of the method is that of taking a number of measurements and averaging the results.

As far as the technical execution is concerned, in order to induce the oscillation it is advisable to use compressed air in a well tube or casing having a borehole haed that is closed off in an airtight manner and that can be opened to the outside instantly by way of a quick-acting gate valve.

A device serving this method comprises a pressure measuring probe which is suspended into the head of fluid in the borehole, and has a spring bellows for measuring the variations in pressure. The deformations of the said bellows being convertible, by actuating movement of a rod, into electrical signals which are conducted to a registering device. The device is characterized by the fact that the pressure measuring probe is equipped with a pressure compensator and as a transducer has a differential transformer whose inductivity may be changed by movement of the rod.

The method of the invention for determining the transmissibility of a fluid-conducting layer, more particularly a conductor of ground water, is based on the stimulation, measurement, and the evaluation of a periodic or an aperiodic damped oscillation of a head of fluid in a borehole which penetrates a fluid-conducting stratum. Because it produces an oscillation, the method may be termed a "build-up method."

THE DRAWINGS

FIG. 1 is a schematic illustrating the apparatus and arrangement and placement of apparatus used in the practice of one embodiment of this invention, and FIG. 2 is a section through a preferred down hole liquid level sensing device for use in the practice of this invention.

DESCRIPTION OF THE PREFERRED EMBODIMENT

The method for determination of the transmissibility of a fluid-conducting layer, especially an aquifer, which is described in the present patent application, is based on the stimulation, the measurement and the analysis of a periodic or an aperiodic damped oscillation of the fluid-level in a borehole penetrating the fluid-conducting layer. There are several possibilities for stimulating, measuring, recording and analyzing the water level movement. This embodiment relates to conductors of ground water. However, it may also be used for other fluid-conducting layers, such as oil-conducting layers.

Figure 1:
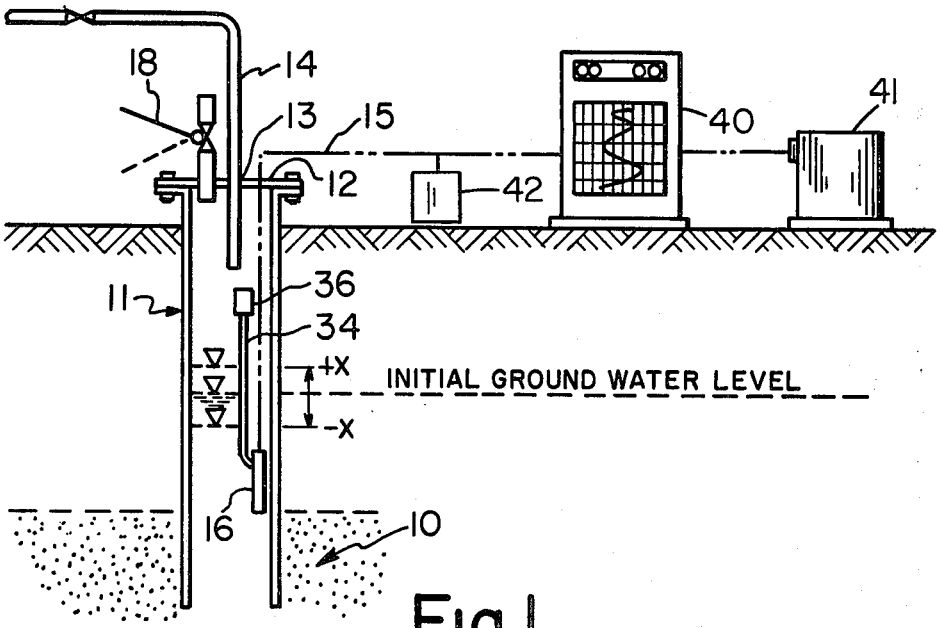

FIG. 1 shows the apparatus for the performance of the method in an aquifer 10. The figure shows a well or bore 11 penetrating a confined aquifer. For an unconfined aquifer the measurement device is the same.

On top of the well-pipe is an air-tight head 12 which is fitted with an inlet 13 for the compressed air pipe 14 and for the electrical current wires 15 to the pressure transducer 16. Furthermore, a quick-acting valve 18 is connected to it which can be opened all of a sudden. Below the water level hangs a pressure transducer 16 for measuring the water level movements. Details of the pressure transducer are explained with reference to FIG. 2. The movement of water (changed in level) is transformed to an electric signal by the transducer 16 and recorded by a compensation recorder 40. The compensation recorder requires an AC input which is provided by AC power supply 41. The AC power supply may derive its power from a battery (not shown). The differential transformer-type transducer requires a DC input signal which is provided by a battery 42.

Figure 2:
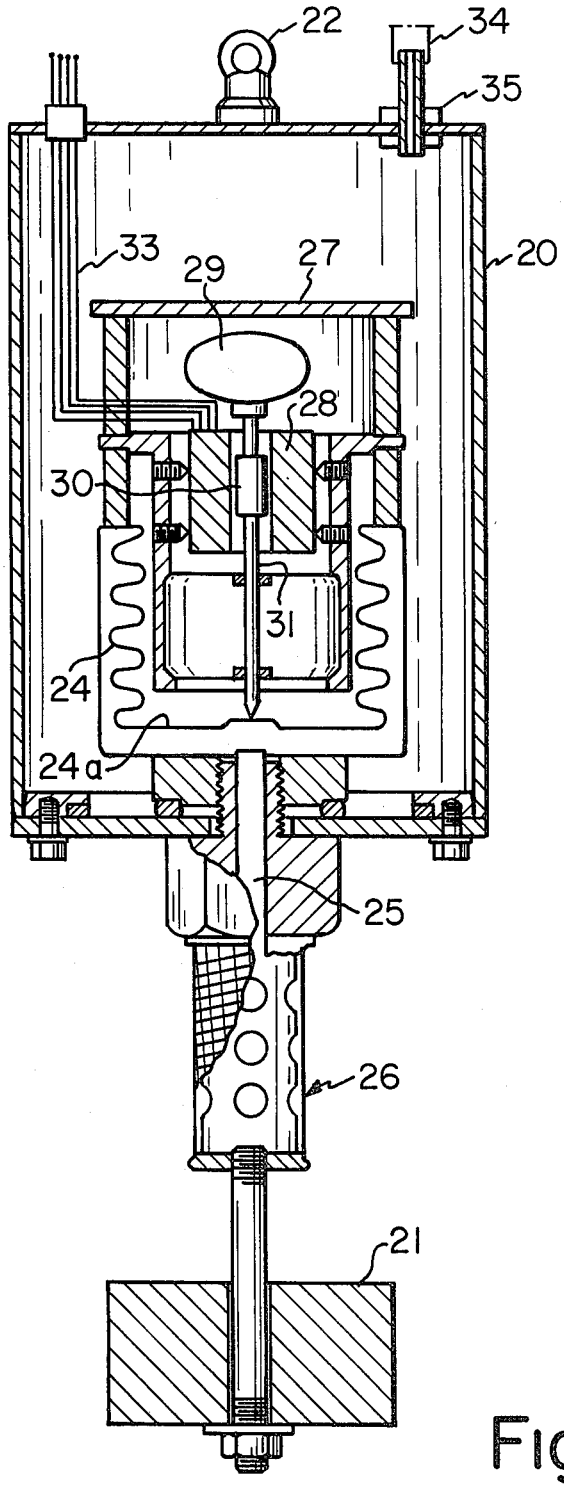

Referring now to FIG. 2, the liquid level detector actually detects the change in ambient water pressure at a location below the surface of the water level. The detector comprises an air-tight casing or housing 20 with a weight 21 attached to the bottom thereof and a hook 22 attached to the top thereof. Thus the casing can be lowered below the water level by a line attached to the hook. Within the casing is a spring bellows 24, the interior of which is in communication via passage 25 and port 26 with the surrounding water.

A frame 27 holds a differential transformer 28 relative to the casing 20. A magnetizable rod 30 is connected to a stem 31 which bears on one end of a movable surface 24*a* of the bellows and on the other end is weakly biased by spring 29. The rod slides within the differential transformer windings. Movement of the rod relative to the windings changes the electrical output signal of the differential transformer in the usual manner.

Leads 33 carrying DC energizing current to the differential transformer and other leads carrying out the signal indicative of the location of the plug passed through the wall of the casing 20. The location of the movable surface 24*a* of the bellows relative to the casing 20 is dependent on the difference in pressure in the ambient water and the pressure within the casing. Since the pressure of the ambient water is due to the head (depth of the bellows below the surface) and also the air pressure over the surface, there must be compensation for changes in air pressure over the surface. This is achieved by air pressure compensator which comprises a conduit 34 attached to port 35 opening into the casing 20 and a bellows 36 in communication with the other end of the conduit 34. The bellows 36 is positioned above the water level. Hence, the pressure in the submerged casing 20 is approximately the pressure at the location of the bellows 36. The bellows 36 must respond rapidly to adjust the air pressure within the casing 20 as air pressure is used to disturb the water level as explained hereafter.

The methods according to this invention comprise, first boring a hole entirely through the aquifer to be tested. The hole above the aquifer is cased and the casing sealed to the bore wall in the case of the confined aquifer. In the case of the unconfined aquifer, the casing extends down into the aquifer a measured distance so that the water level above the end of the casing may be known. The water level detector is then emplaced below the surface of the initial ground water level and the air pressure compensator is placed above the water level and the head is placed over the hole casing. The head valve closed, the water is lowered some decimeter below the initial stage by compressed air (0.1 to 1 bar) led into the well. This phase is maintained for 0.5 to 1 minute. Then the pressure is suddenly released by opening the valve. That causes the water rise to the initial level either oscillating or exponentially damped. The movement of the water level is the "free oscillation" of the well-aquifer system. It may last some seconds till several minutes. The free oscillation can be used to determine the transmissibility of the aquifer.

In an oscillating or exponentially damped build-up transient oscillation process the water level returns to its initial level. The duration of the build-up oscillation process is on the order of several seconds of several minutes.

This build-up transient oscillation process which is induced in the manner described above is utilized to determine the transmissibility.

The damping coefficient $\beta$ of the oscillation is inversely proportional to the transmissibility T. The phase $\tau$ of the oscillation and thereby the inherent frequency $\omega_w$ are determined from the measured build-up transient oscillation process. For this it is practicable first of all to compute the build-up transient oscillation process with all the $\beta$ and $\omega_w$ combinations that occur in the well ground water conductor system on the basis of the oscillation equations of the damped harmonic oscillator and to represent them graphically in a suitable form. The comparision of the measured building-up transient oscillation process with these "standard curves" whose rise E is now determined by $\beta$ and $\omega_w$, makes it possible to ascertain these parameters quickly with the measured building-up transient oscillation process.

With a known well radius $r_w$, the transmissibility T is as follows:

$$T = 1.3 \times r_w^2 \cdot \omega_w / \beta \cdot \text{ (meters squared per second)}$$

No draining well with a large diameter and expensive filters are required for the building-up transient oscillation process described above. On the contrary, only one borehole with a 2 to 4 inch diameter need be sunk into the fluid-conducting layer. An inexpensive filter tube may be inserted in one portion of the casing of the well.

In the building-up transient oscillation process no special observation tubes need be installed. No pumping installation with a great demand on energy and with costly draining-off of the conveyed water are required for the building-up transient oscillation process. No expensive measuring instruments for determining the quantity being delivered and the course of the water level are required at a number of observation tubes. The building-up transient oscillation process can be carried out without any road-building operations in any terrain and in all kinds of weather, which is not the case in pump testing. The building-up transient oscillation process can be carried out in an area of about 1 square meter. It is, therefore, suitable for use on narrow public parcels of roads, under overpasses, and in buildings where pump tests are scarcely possible. The employment of personnel is small. The total measuring time for the building-up transient oscillation process is about 1 hour, while the pumping test takes from days to many weeks. Additional advantages over against the pump tests result therefrom.

Due to the speed of its execution, in the building-up transient oscillation process no adulteration of the measuring results through meteorological, hydrological, and anthropogenic influences need be feared. The term of employment of the personnel in carrying out the building-up transient oscillation process is substantially shorter than in the case of the pump tests. Consequently, it becomes economically possible to employ particularly highly qualified personnel and achieve correspondingly accurate results. Due to the short time required for carrying out the process and due to the concentration of the measuring device to one place, the building-up transient oscillation process can be more readily supervised by the contractor than is the case with the pump tests.

As for the legal aspects, there are also advantages to the building-up transient oscillation process in comparison with the pump test. It entails no bringing up of the ground water to the surface, thereby eliminating a previous process requiring water rights. No alien water rights are affected by the building-up transient oscillation process.

Due to its low expense, the building-up transient oscillation process is particularly suitable for ascertaining the transmissibility and permeability coefficients in areas for obtaining ground water and entire ground water landscapes in large areas, and areas of different geological sections.

On the basis of these values it is possible, among other things, to compute ground water models. The building-up transient oscillation process delivers results that can be reproduced very well. Consequently, it can be utilized to particular advantage for control measurements that must be repeated frequently.

Having thus defined my invention with the detail and particularity as required by the Patent Laws, what is desired protected by Letters Patent is set forth in the following claims.

I claim:

1. Method for the determination of the transmissibility of a fluid-conducting borehole layer, especially of an aquifer, comprising the steps of stimulating the fluid-level in a borehole to a periodic or an aperiodic damped oscillation, measuring the movement of the fluid-level with a pressure transducer, recording the movement of the fluid-level on a digital or analog recorder, and evaluating the recorded movement to produce a factor related to the transmissibility.

2. The method according to claim 1 comprising using compressed air in a borehole with an air-tight head which can be opened all of a sudden to stimulate the water level.

3. The method according to claims 1 or 2 wherein a pressure transducer hangs below the water level in the borehole, a bellows is positioned above the water level and is connected to the transducer as a compensation device for the air pressure, said transducer measuring the variations of the fluid-level as differences of pressure of the water head and producing an electrical signal indicative thereof.

4. Method for the determination of the transmissibility of a fluid-conducting borehole layer, especially of an aquifer, comprising the steps for stimulating the fluid-level in a borehole to a periodic or aperiodic damped oscillation, measuring the movement of the fluid-level with a pressure transducer, recording the movement of the fluid-level on a digital or analog compensation recorder, and evaluating the recorded movement using special equations, based on the physical relations, and/or applying a graphic method using typecurves.

5. The method of claim 4 comprising repetition of measurements and normalizing of the results by taking their average.

6. The method of claim 4 comprising by using compressed air in said borehole with an air-tight head, which can be opened all of a sudden.

* * * * *